US007655303B1

(12) United States Patent
Chen

(10) Patent No.: US 7,655,303 B1
(45) Date of Patent: Feb. 2, 2010

(54) COMPOSITE TUBING

(75) Inventor: Chin-Yuan Chen, Chiayi Hsien (TW)

(73) Assignee: Qingdao Jian Quan Ltd., Qingdao, Shandong (CN)

( * ) Notice: Subject to any disclaimer, the term of this patent is extended or adjusted under 35 U.S.C. 154(b) by 29 days.

(21) Appl. No.: 12/179,417

(22) Filed: Jul. 24, 2008

(51) Int. Cl.
*D02G 3/00* (2006.01)

(52) U.S. Cl. ..... 428/370; 428/398; 428/34.1; 428/36.9; 428/373; 297/451.9

(58) Field of Classification Search ..... 428/358, 428/370, 373, 374, 398; 442/199, 188, 123; 297/451.9
See application file for complete search history.

(56) References Cited

U.S. PATENT DOCUMENTS 2,008,313 A * 7/1935 Presby ..... 493/336
3,876,495 A * 4/1975 Esler ..... 428/398
5,470,656 A * 11/1995 Kennard et al. ..... 428/370
5,616,411 A * 4/1997 Barber et al. ..... 428/373
6,096,423 A * 8/2000 Pavan ..... 428/379
7,476,630 B2 * 1/2009 Schwartz et al. ..... 442/208
2008/0220254 A1 * 9/2008 Shieh ..... 428/373
2008/0261040 A1 * 10/2008 Chen ..... 428/358

* cited by examiner

*Primary Examiner*—N. Edwards
(74) *Attorney, Agent, or Firm*—Zaretsky Patent Group PC; Howard Zaretsky

(57) ABSTRACT

A composite tubing includes: an outer tubing which is prepared by seaming along a lengthwise direction two lateral sides of a lengthwise-extending strip made from a deformable material, the lateral sides being disposed opposite to each other in a transverse direction relative to the lengthwise direction, and being superimposed on each other so as to form a tubular body and a seamed ridge, the tubular body including a force-bearing-side half and a ridge-side half cooperating with each other to define a compressible tubular chamber, the seamed ridge extending from the ridge-side half radially and lengthwise; and a fiber-based rope disposed to extend lengthwise in the compressible tubular chamber, and being of a dimension such that, when the force-bearing-side half is pressed and deformed, the fiber-based rope is shiftable against the ridge-side half so as to vest the tubular body with an increased strength while preserving the padding effect of the force-bearing-side half.

8 Claims, 3 Drawing Sheets

COMPOSITE TUBING

BACKGROUND OF THE INVENTION

1. Field of the Invention

This invention relates to a composite tubing, more particularly to a composite tubing having an outer tubing and a fiber-based rope.

2. Description of the Related Art

Materials for woven furniture and articles, e.g., chairs and seat cushions, include natural materials, e.g., rattan, and synthetic materials, e.g., plastics. The disadvantages of using rattan as a weaving material reside in high material cost, limited rattan resources, and relative discomfort due to the rigid property of rattan. Although plastics are relatively inexpensive and easy to obtain, they do not have sufficient durability.

SUMMARY OF THE INVENTION

Therefore, the object of the present invention is to provide a composite tubing that can overcome the aforesaid drawbacks of the prior art.

According to this invention, a composite tubing includes: an outer tubing which is prepared by seaming along a lengthwise direction two lateral sides of a lengthwise-extending strip made from a deformable material, the lateral sides being disposed opposite to each other in a transverse direction relative to the lengthwise direction, and being superimposed on each other so as to form a tubular body and a seamed ridge, the tubular body including a force-bearing-side half and a ridge-side half opposite to each other in the transverse direction and cooperating with each other to define a compressible tubular chamber, the seamed ridge extending from the ridge-side half radially and lengthwise to thereby render deformability of the ridge-side half less than that of the force-bearing-side half; and a fiber-based rope disposed to extend lengthwise in the compressible tubular chamber, and being of a dimension such that, when the force-bearing-side half is pressed and deformed, the fiber-based rope is shiftable against the ridge-side half so as to vest the tubular body with an increased strength while preserving the padding effect of the force-bearing-side half.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
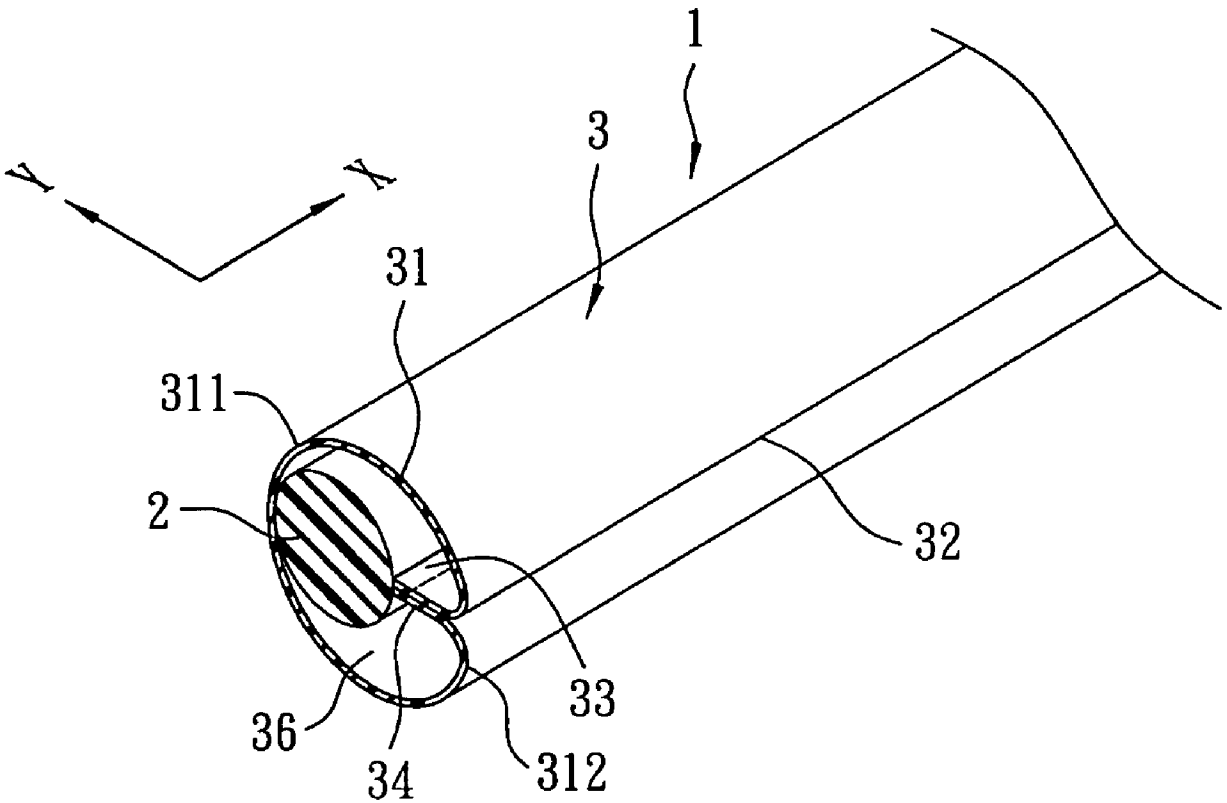
FIG. 1 is a fragmentary perspective view of the preferred embodiment of a composite tubing according to this invention.
Figure 2:
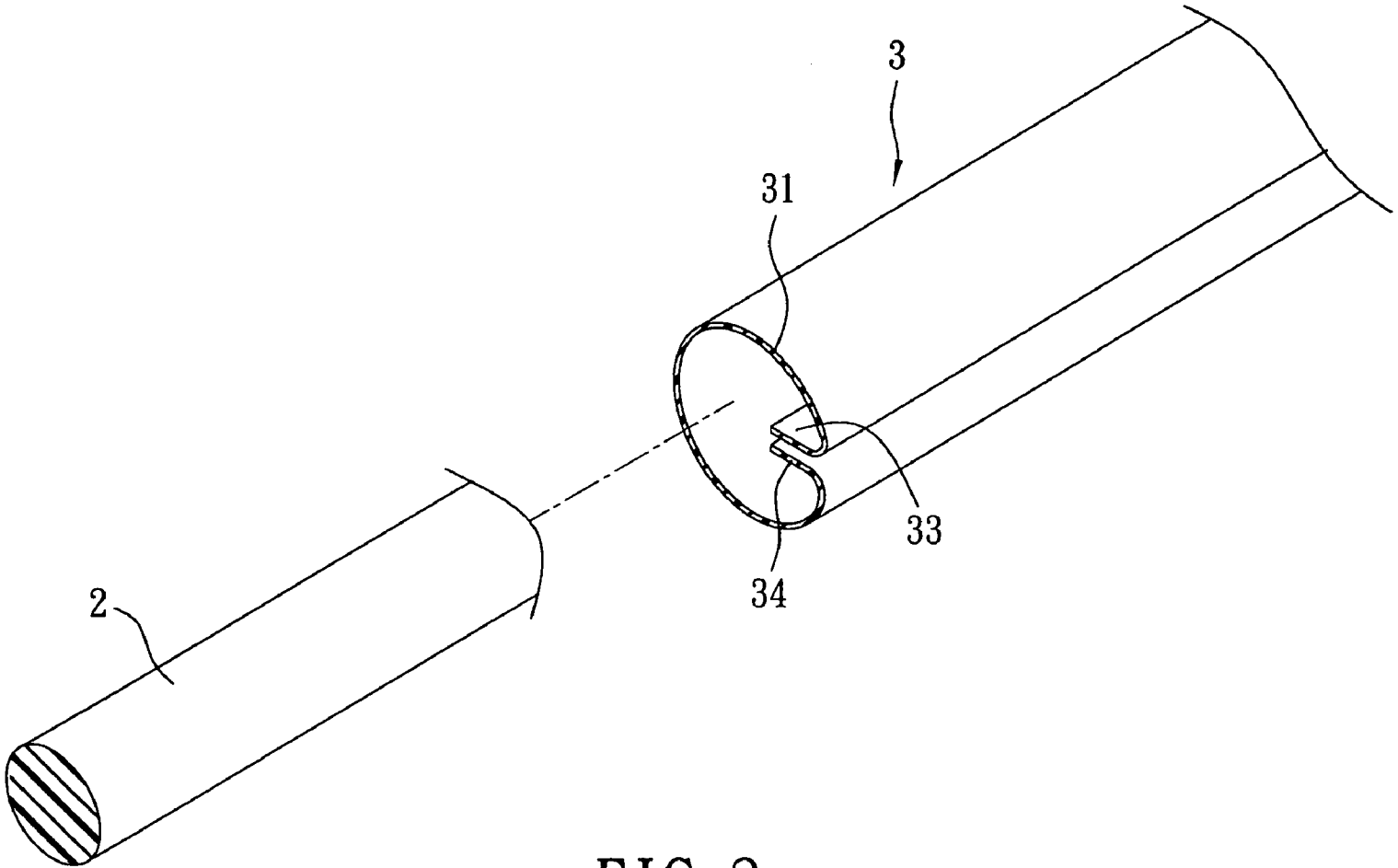
FIG. 2 is an exploded fragmentary perspective view of the preferred embodiment shown in FIG. 1.

Referring to FIGS. 1 and 2, the preferred embodiment of a composite tubing 1 according to the present invention is shown to include a fiber-based rope 2 and an outer tubing 3.

The outer tubing 3 is prepared by seaming along a lengthwise direction (X) two lateral sides 33, 34 of a lengthwise-extending strip. The lateral sides 33, 34 are disposed opposite to each other in a transverse direction (Y) relative to the lengthwise direction (X), and are superimposed on each other so as to form a tubular body 31 and a seamed ridge 32. The lengthwise-extending strip is made from a deformable material, e.g., a plastic material or artificial leather.

The tubular body 31 includes a force-bearing-side half 311 and a ridge-side half 312 opposite to each other in the transverse direction (Y) and cooperating with each other to define a compressible tubular chamber 36. The seamed ridge 32 extends from the ridge-side half 312 radially and lengthwise to thereby render deformability of the ridge-side half 312 less than that of the force-bearing-side half 311.

The fiber-based rope 2 is disposed to extend lengthwise in the compressible tubular chamber 36. The fiber-based rope 2 is of a dimension such that, when the force-bearing-side half 311 is pressed and deformed, the fiber-based rope 2 is shiftable against the ridge-side half 312 so as to vest the tubular body 31 with an increased strength while preserving the padding effect of the force-bearing-side half 311.

Suitable materials for the fiber-based rope 2 include a natural fiber and a synthetic fiber. Examples of the natural fiber include hemp, linen, cotton, coir, jute, flax, and sisal. Examples of the synthetic fiber include polypropylene, nylon, polyester, and polyethylene.

As shown in FIGS. 1 and 2, preferably, the seamed ridge 32 radially extends from the ridge-side half 312 into the compressible tubular chamber 36.

Figure 3:
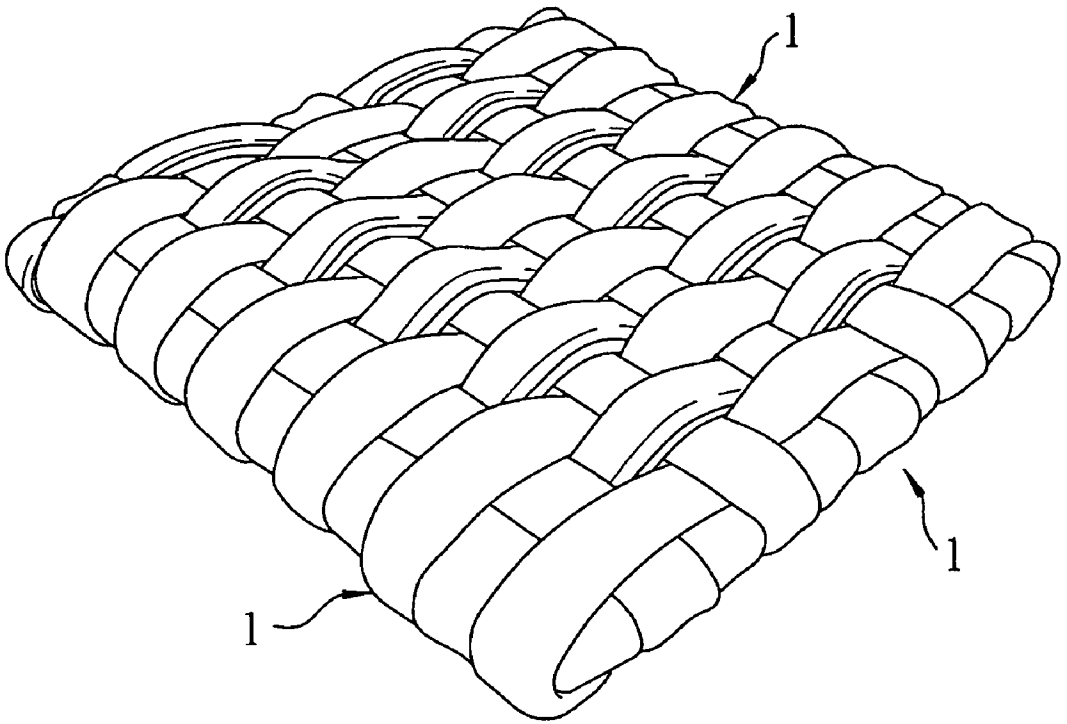
FIG. 3 is a perspective view showing an article made from the composite tubings of the preferred embodiment shown in FIG. 1.

As shown in FIG. 3, the composite tubings 1 according to this invention can be interlaced to form an article or an item of furniture having padding/cushioning effect. In particular, the force-bearing-side half 311 of the outer tubings 31 serve as a padding surface of the article. As described above, when the force-bearing-side half 311 are subjected to an external force (e.g., sitting force), the fiber-based rope 2 is shiftable against the ridge-side half 312 so as to vest the tubular body 31 with an increased strength. In addition, the space between the outer tubing 3 and the fiber-based rope 2 in the compressible tubular chamber 36 improves the softness for the padded article.

According to the structure of the composite tubing 1, the seamed ridge 32 formed at the ridge-side half 312 and the fiber-based rope 2 disposed in the compressible tubular chamber 36 can provide superior tensile strength for the composite tubing 1. In addition, the space in the compressible tubular chamber 36 improves the softness of the interlaced padded article.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A composite tubing capable of being interlaced for padding an article of furniture, said composite tubing comprising:

an outer tubing which is prepared by seaming along a lengthwise direction two lateral sides of a lengthwise-extending strip made from a deformable material, said lateral sides being disposed opposite to each other in a transverse direction relative to the lengthwise direction, and being superimposed on each other so as to form a tubular body and a seamed ridge, said tubular body including a force-bearing-side half and a ridge-side half opposite to each other in the transverse direction and cooperating with each other to define a compressible tubular chamber, said seamed ridge extending from said ridge-side half radially and lengthwise to thereby render deformability of said ridge-side half less than that of said force-bearing-side half; and a fiber-based rope disposed to extend lengthwise in said compressible tubular chamber, and being of a dimension such that, when said force-bearing-side half is pressed and deformed, said fiber-based rope is shiftable against said ridge-side half so as to vest said tubular body with an increased strength while preserving the padding effect of said force-bearing-side half.

2. The composite tubing of claim 1, wherein said seamed ridge radially extends from said ridge-side half into said compressible tubular chamber.

3. The composite tubing of claim 1, wherein said deformable material is a plastic material.

4. The composite tubing of claim 1, wherein said deformable material is artificial leather.

5. The composite tubing of claim 1, wherein said fiber-based rope is made from a natural fiber.

6. The composite tubing of claim 5, wherein said natural fiber is at least one of hemp, linen, cotton, coir, jute, flax, and sisal.

7. The composite tubing of claim 1, wherein said fiber-based rope is made from a synthetic fiber.

8. The composite tubing of claim 7, wherein said synthetic fiber is made from at least one of polypropylene, nylon, polyester, and polyethylene.

* * * * *